US006722619B2

(12) United States Patent
Valiulis et al.

(10) Patent No.: US 6,722,619 B2
(45) Date of Patent: Apr. 20, 2004

(54) SPACE-SAVING DISPLAY HOOK BACK FOR PEGBOARD

(75) Inventors: Stanley C. Valiulis, Rockford, IL (US); Craig Zadak, Roscoe, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 10/025,254

(22) Filed: Dec. 18, 2001

(65) Prior Publication Data

US 2003/0080265 A1 May 1, 2003

Related U.S. Application Data

(63) Continuation-in-part of application No. 29/153,126, filed on Oct. 29, 2001.

(51) Int. Cl.[7] ..... A47B 96/06
(52) U.S. Cl. ..... 248/220.31
(58) Field of Search ..... 248/220.31, 220.41, 248/304, 301, 220.34

(56) References Cited

U.S. PATENT DOCUMENTS

| | | | | | |
|---|---|---|---|---|---|
| 3,193,231 | A | | 7/1965 | Curry | |
| 3,195,846 | A | * | 7/1965 | Dahlhauser | 248/220.42 |
| 3,216,584 | A | * | 11/1965 | Sedo | 221/59 |
| 3,591,117 | A | | 7/1971 | Mazzetti | |
| 3,601,432 | A | | 8/1971 | Fenwick | |
| 3,640,497 | A | | 2/1972 | Waki | |
| 3,908,949 | A | | 9/1975 | Larson | |
| 4,303,217 | A | | 12/1981 | Garfinkle | |
| 4,304,382 | A | | 12/1981 | Jelen | |
| 4,352,478 | A | * | 10/1982 | Loew | 248/220.31 |
| 4,387,872 | A | | 6/1983 | Hogue | |
| 4,441,619 | A | * | 4/1984 | Gibitz | 211/59.1 |
| 4,452,360 | A | * | 6/1984 | Barnes | 211/59.1 |
| 4,619,428 | A | | 10/1986 | Bailey | |
| 4,671,417 | A | * | 6/1987 | O'Brien | 211/59.1 |
| 5,035,388 | A | * | 7/1991 | Nagel | 248/220.22 |
| 5,109,993 | A | * | 5/1992 | Hutchison | 211/59.1 |
| 5,407,160 | A | * | 4/1995 | Hollingsworth et al. | 248/220.43 |
| 5,505,314 | A | * | 4/1996 | O'Brien | 211/59.1 |
| 5,531,415 | A | | 7/1996 | Kallemeyn | |
| 5,607,132 | A | | 3/1997 | Baldwin | |
| 6,234,436 | B1 | * | 5/2001 | Kump | 211/59.1 |
| 6,266,250 | B1 | | 7/2001 | Foye | |
| 6,349,909 | B1 | * | 2/2002 | Zarrow et al. | 211/57.1 |
| 2001/0013567 | A1 | * | 8/2001 | Valiulis | 248/220.41 |

* cited by examiner

*Primary Examiner*—Ramon O. Ramirez
*Assistant Examiner*—Kofi A. Schulterbrandt
(74) *Attorney, Agent, or Firm*—Leydig, Voit & Mayer, Ltd.

(57) ABSTRACT

A mounting bracket generally comprises a plate and a pair of laterally spaced prongs connected to the plate. Each prong has a first portion extending rearwardly and a second portion extending downwardly. The second portion of each prong has a vertical height less than or equal to a diameter of the mounting apertures, whereby the bracket may be attached to the vertical support without rotating the bracket, thereby saving retail space. An interior chamber is defined by the rear surface of the plate and the inner surfaces of the prongs. The interior chamber has a horizontal width less than or equal to the thickness of the vertical support such that the rear and inner surfaces firmly engage the vertical support and attach the mounting bracket thereto. Preferably, the bracket further includes a second pair of laterally spaced prongs structured similarly to the first pair of prongs but vertically spaced therefrom.

12 Claims, 6 Drawing Sheets

20
60
60
40
42
48
41

20
60
60
44
40
48
45
45
48
41
46

60
20
40
44
60
48
45
48
45
41
46

60
61
44
60
40
62
45
42
45
70
71
72
73
72
46

SPACE-SAVING DISPLAY HOOK BACK FOR PEGBOARD

CROSS-REFERENCE TO RELATED PATENT APPLICATIONS

This patent application is a continuation-in-part of copending U.S. patent application Ser. No. 29/153,126 (not issued by the U.S. Patent and Trademark Office), filed Oct. 29, 2001.

FIELD OF THE INVENTION

The present invention relates generally to hanger assemblies for perforated vertical supports, and more particularly relates to mounting backs for such hanger assemblies.

BACKGROUND OF THE INVENTION

This invention relates to a hanger assembly for supporting articles on a vertical support such as a perforated panel of the type commonly referred to as a "Pegboard." Such an assembly includes a hanger or hook adapted to project outwardly from the vertical support and adapted to hold merchandise. In most hanger assemblies, the hook is adapted to be releasably attached to the panel by a mounting bracket having a pair of horizontally spaced fingers or pegs which extend through holes in the pegboard. The pegs are typically L-shaped, and extend inwardly and upwardly such that the hanger assembly must be tilted upwardly to insert the pegs into the holes. Once the upturned portion of the pegs are inserted into the holes, the assembly may be rotated downwardly so that the hook projects outwardly from the vertical support.

Unfortunately, while such hanger assemblies have achieved much commercial success, they are not without their limitations. It can often be difficult to install the hanger assemblies immediately below other product display devices such as shelves, crossbars, wire bins and baskets, or even other hanger assemblies which can obstruct vision and make mounting the hanger difficult. Since the mounting backs must be tipped upwardly and since hooks are relatively long, significant space is required above the assembly to mount the assembly to a vertical support.

BRIEF SUMMARY OF THE INVENTION

One embodiment of the invention provides a mounting bracket for mounting a display hook to a vertical support having regularly spaced apertures. The mounting bracket generally comprises a plate having a front surface constructed to attach the display hook thereto, and a pair of laterally spaced prongs connected to the plate for attaching the plate to the vertical support via the apertures. Each of the prongs has a first portion extending rearwardly from the plate and a second portion extending downwardly from the first portion. The second portion of each prong has a vertical height less than or equal to a diameter of the apertures, so that the bracket may be attached to the vertical support without any rotation or tilting of the bracket and display hook. Further, an interior chamber is defined by the rear surface of the plate and the inner surfaces of the first and second portions of the prongs. The interior chamber has a horizontal width less than or equal to the thickness of the vertical support such that the rear and inner surfaces firmly engage the vertical support and attach the mounting bracket thereto.

According to more detailed aspects of this embodiment of the invention, the horizontal width of the chamber is between about 0.230 to about 0.235 inches. The horizontal width is less than the thickness of the vertical support, and the prongs compress the vertical support when attached thereto. According to another aspect, an upper portion of the plate extends above the inner surface of the first portion of the prongs to provide rotational stability. Preferably, the prongs are integrally formed with the plate and positioned adjacent a top edge of the plate. The bracket is preferably stamp formed from sheet metal.

In a related embodiment, the mounting bracket further comprises a second pair of laterally spaced prongs structured similarly to the first pair of prongs but vertically spaced therefrom. Like the first pair of prongs, the inner surfaces of the first and second portions of the second pair of prongs define a second chamber for receiving the vertical support therein. Preferably, a lower portion of the plate extends below the inner surfaces of the first portions of the second pair of prongs to provide rotational stability. More preferably, the lower portion of the plate extends below the second portions of the second pair of prongs.

In another embodiment of the invention, a mounting bracket is provided for mounting a display hook to a vertical support having regularly spaced apertures. The mounting bracket generally comprises a plate having a front surface constructed to attach the display hook thereto, and a first and second pair of laterally spaced prongs connected to the plate for attaching the plate to the vertical support via the apertures. The first pair of prongs is vertically spaced above the second pair of prongs. Each prong has a first portion extending rearwardly from the plate and a second portion extending downwardly from the first portion. The first portion of each prong extends rearwardly a distance less than or equal to the thickness of the vertical support for secure attachment. The second portion of each prong has a vertical height less than or equal to a diameter of the apertures so that the bracket may be attached to the vertical support without any rotation or tilting of the bracket and display hook.

According to more detailed aspects of this embodiment, a rear surface of plate lies generally flush with vertical support. Each prong includes an inner surface that firmly engages the vertical support. Preferably, the first portion of each prong extends a horizontal distance less than the thickness of the vertical support, and the prongs compress the vertical support when attached thereto.

Other objectives and advantages of the invention will become more apparent from the following detailed description when taken in conjunction with the accompanying drawings.

Figure 1:
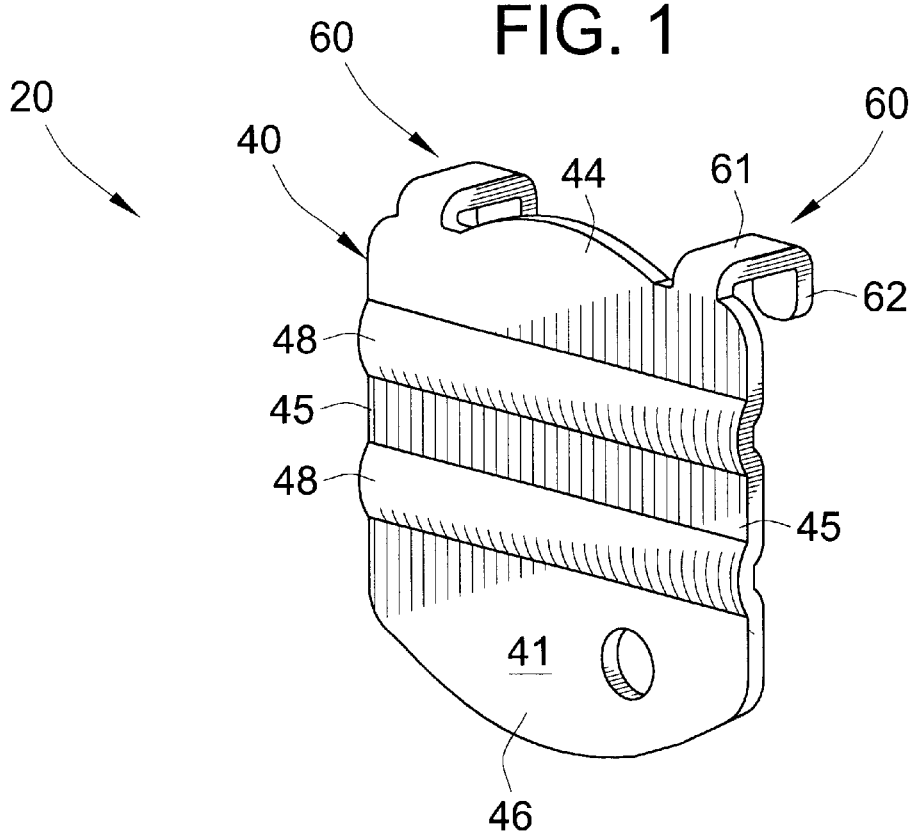
FIGS. 1–5 are front isometric, rear isometric, top, front and side view of a mounting back in accordance with a first embodiment of the present invention.

The accompanying drawings incorporated in and forming a part of the specification illustrate several aspects of the present invention, and together with the description serve to explain the principles of the invention. In the drawings:

FIG. 1 is [insert a brief description of each drawing, being sure that each drawing is separately labeled (e.g., 1, 2A, 2B, 3, 4, etc.) and individually described].

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, a first embodiment of the present invention is depicted in FIGS. 1–5. This embodiment of the invention takes the form of a mounting bracket 20 generally comprising a plate 40 and a pair of mounting fingers or prongs 60. It can be seen that the pair of prongs 60 are connected to the plate and are laterally spaced apart. Preferably, the pair of laterally spaced prongs 60 are connected to the plate adjacent an upper edge thereof. Also preferable, the prongs are integrally formed with the plate. Generally, the bracket is stamped formed from sheet metal.

Figure 2:
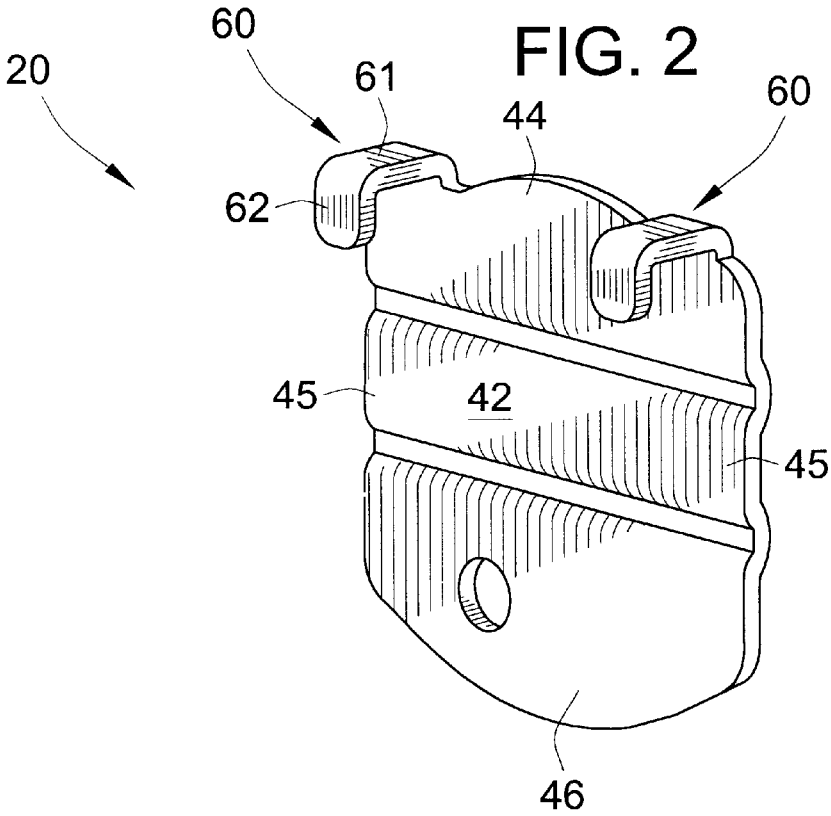
Figure 3:
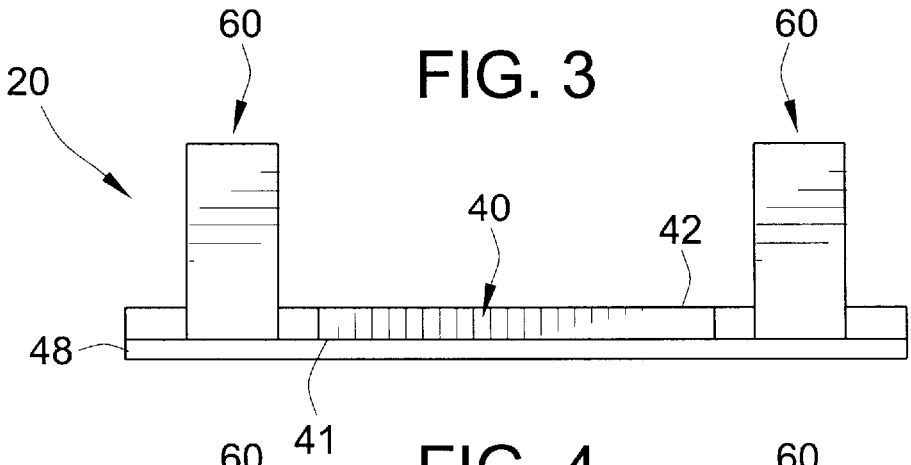
Figure 4:
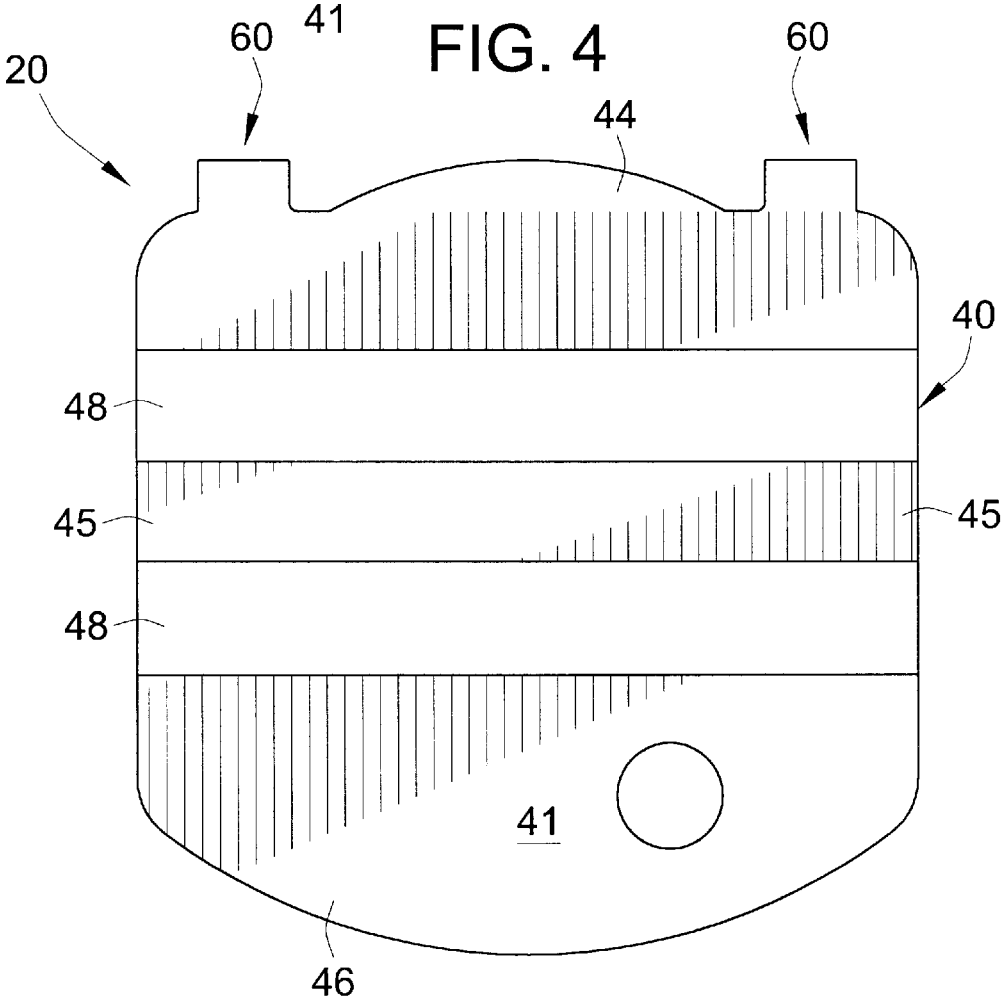
Figure 5:
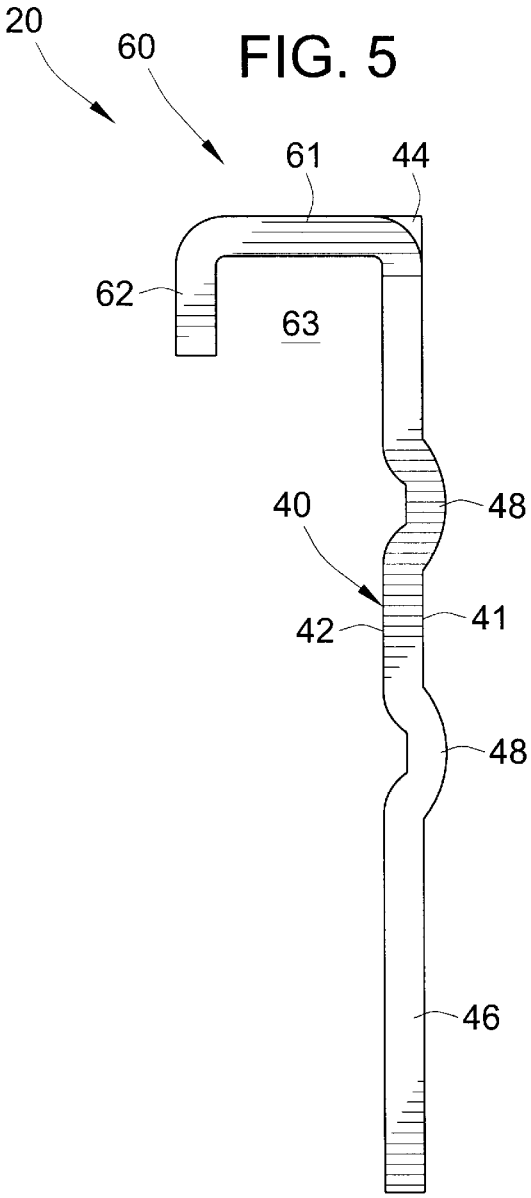
Figure 11:
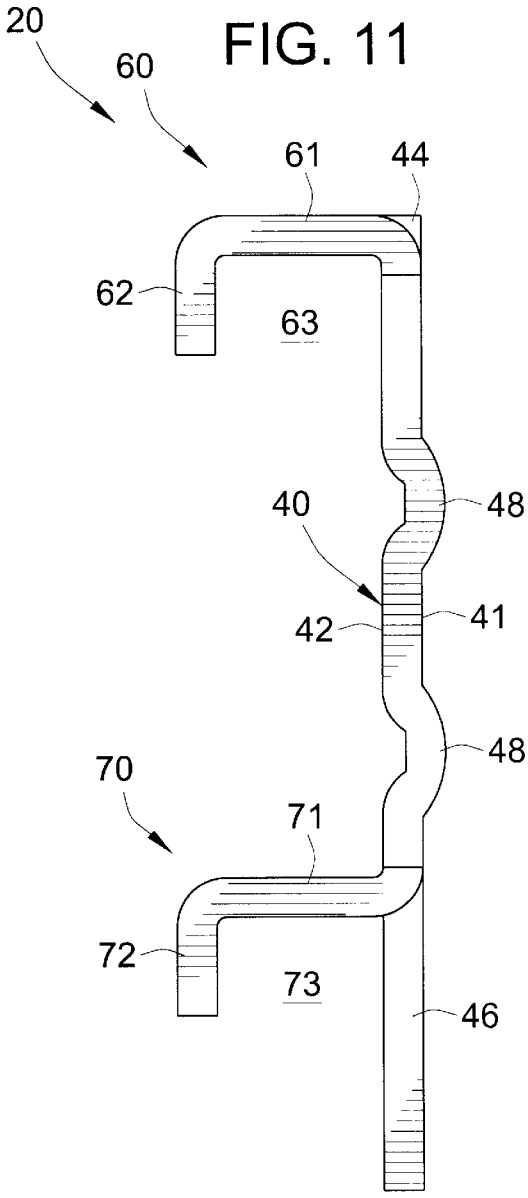
FIGS. 6–11 are similar views to those shown in FIGS. 1–5 but of a mounting back in accordance with a second embodiment of the present invention.
Figure 6:
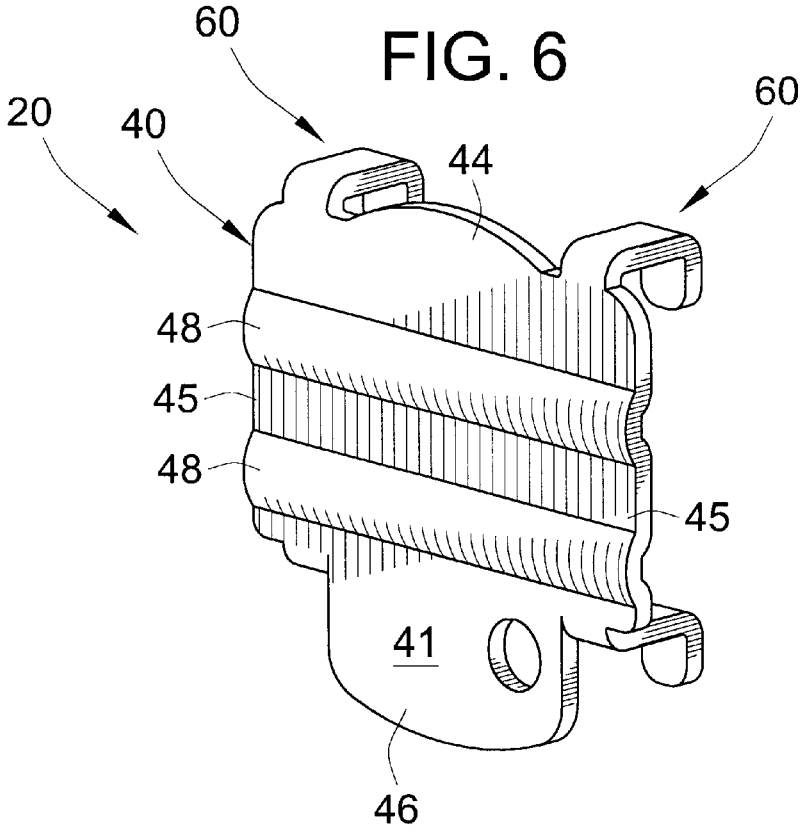
Figure 7:
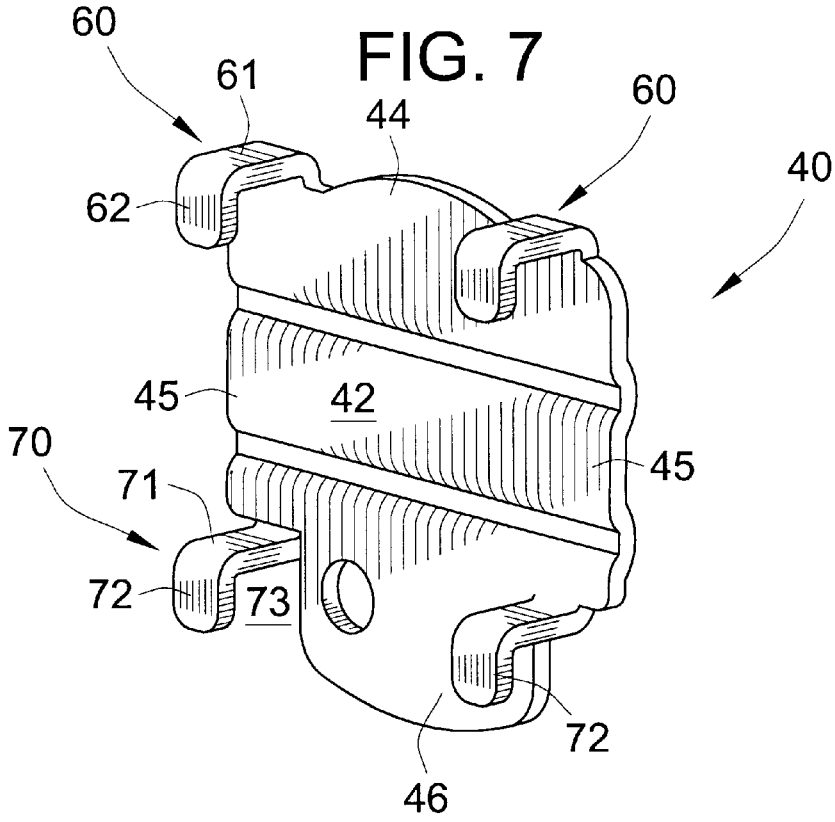
Figure 8:
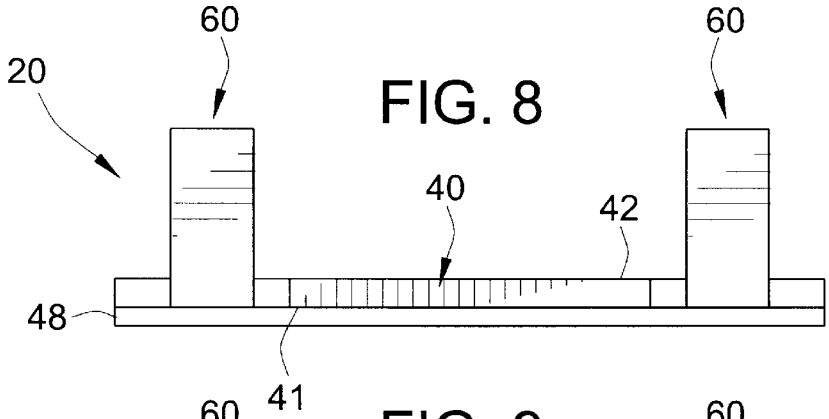
Figure 9:
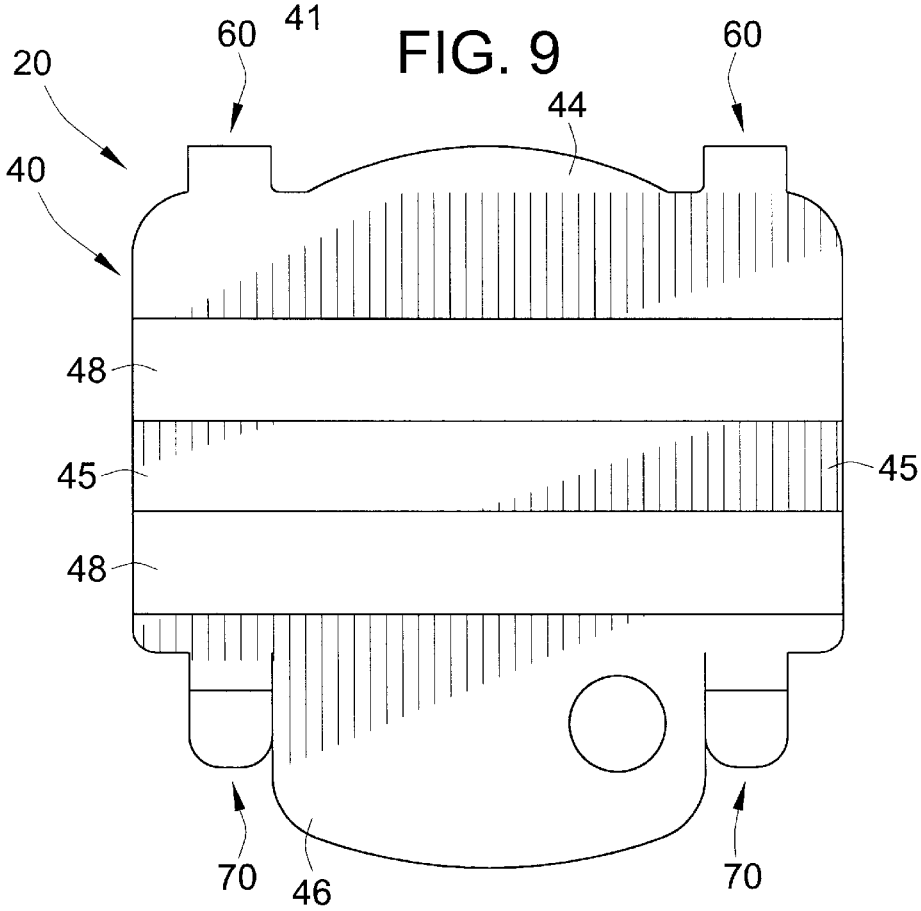
Figure 10:
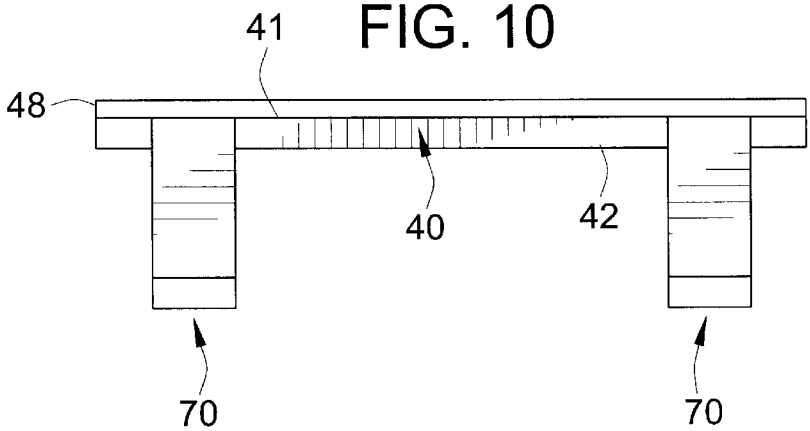

The plate 40 is generally rectangular, and is about 1–2 inches wide, by 1–1½ inches tall. The laterally spaced prong 60 on lateral sides of the bracket 20, and the relatively large dimension in the width, allows two or more display hooks to be mounted to the single mounting bracket. As will be recognized by those skilled in the art, a bracket having two vertically spaced prongs is also envisioned, and could be used to mount a single display hook thereto. The plate 40 generally includes a front surface 41 (FIG. 1) and a rear surface 42 (FIG. 2). The plate 40, and particularly the front surface 41 is constructed to attach a display hook (not shown) thereto. In the embodiment depicted in FIGS. 1–5, a pair of vertically spaced and laterally extending bosses 48 are formed into the plate 40 for attaching a display hook thereto, typically by welding.

Each prong 60 generally comprises a first portion 61 and a second portion 62. The first portion 61 is connected to the plate 40 and extends rearwardly therefrom, while the second portion 62 extends downwardly from the first portion 61. The inner surfaces of the first portion 61 and the second portion 62, as well as the rear surface 42 of the plate 40, generally define an interior chamber 63 (FIG. 5) that is sized to receive a vertical support. More particularly, and as will be described in more detail herein, the second portion 62 of each prong 60 is sized to be less than or equal to the diameter of a hole in the vertical support. With this construction, the pegs 60 may be directly inserted horizontally through the apertures found in the vertical support (not shown). Furthermore, the first portion 61 is sized to be less than or equal to a thickness of the vertical support, such that the prongs 60 firmly engage the vertical support and attach the mounting bracket 20 thereto.

Another embodiment of the present inventions is depicted in FIGS. 6–11. This embodiment is very similar to the embodiment of FIGS. 1–5, although a second pair of laterally spaced prongs 70 are provided. The second pair of prongs 70 are vertically spaced from the first pair of prongs 60. More particularly, the second pair of prongs 70 are positioned adjacent the lower portion 46 of the plate 40. In fact, the lower portion 46 has a smaller width than the lower portion 46 of the first embodiment. This is because in the depicted embodiment, the second pair of prongs 70 are struck from the lower portion 46 of the plate leaving lesser plate material.

Nonetheless, it can also be seen that on each of the side edges of the mounting bracket 20, the plate 40 extends laterally beyond the outer edges of the vertically spaced prongs 60, 70, as they do in the prior embodiment. Thus the plate defines side portions 45 extending laterally beyond the vertically spaced prongs 60, 70 which provides support against lateral rotation. It will also be noticed that the upper portion 44 extends to a point above the inner surface of the first portion 61 of the first pair of prongs 60, and in fact extends to a point equal to or above the prongs 60. Similarly, the lower portion 46 of the plate 40 extends downwardly below the inner (i.e. lower) surface of the first portion 71 of the lower pair of prongs 70, and preferably extends downwardly to a point equal to or below the entire prongs 70, including the downturned second portion 72.

Figure 13:
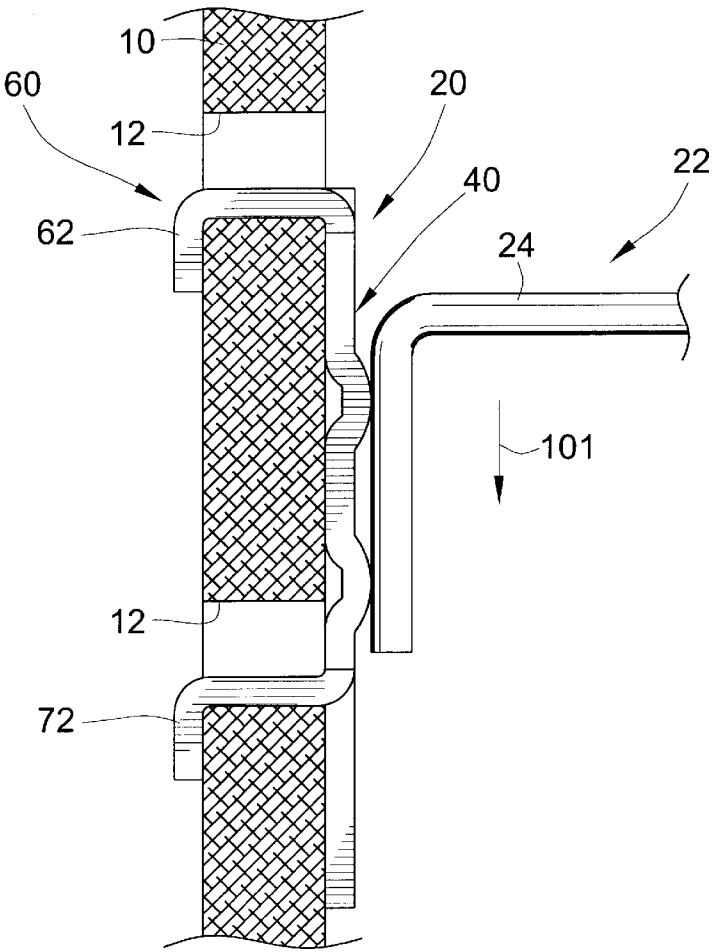
FIGS. 12 and 13 are illustrations showing the mounting back of the second embodiment being mounted to a perforated peg hook board.
Figure 12:
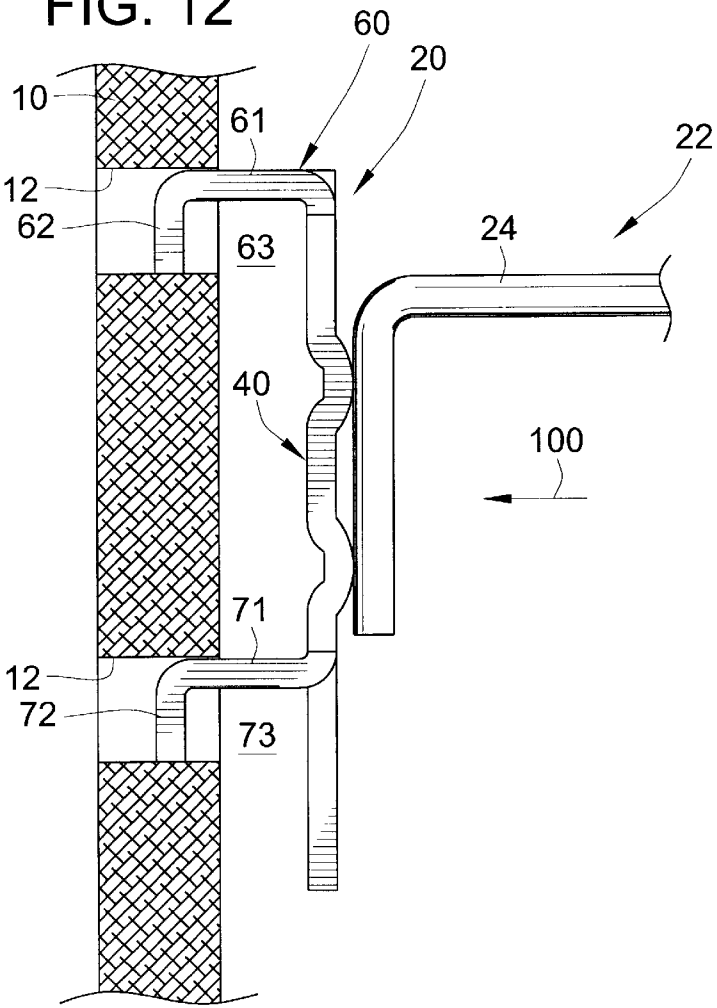

The embodiment of the invention depicted in FIGS. 6–11 has been illustrated as being mounted to a vertical support 10 having regularly spaced apertures 12 in FIGS. 12 and 13. Here, the invention takes the form of a hanger assembly 22 having a display hanger 24 affixed to the mounting bracket 20 via the bosses 48. In FIG. 12, the hanger assembly 22 is being shown as moving laterally by arrow 100, and it can be seen that the downturned second portions 62, 72 of the prongs 60, 70 are sized in the vertical dimension to be received within the apertures 12. As shown in FIG. 13, once the hanger assembly 22 has been moved inwardly, the assembly and its bracket 20 may be moved downwardly as indicated by arrow 101. It can be seen that the first portions 61, 71 of the prongs 60, 70 are sized to be equal to or less than the thickness of the vertical support 10, such that the inner surfaces of the prongs 60, 70 firmly engage the vertical support 10. Stated another way, the chambers 63, 73 (FIG. 12) formed by the prongs 60, 70 and the plate 40, are sized in the horizontal dimension to be approximately less than or equal to the thickness of the vertical support for firm engagement. It can also be seen that the rear surface 42 of the plate 40 lies generally flush with the outer surface of the vertical support 10.

Accordingly, the hanger assembly 22, and more particularly the bracket 20, need not be rotated or otherwise tilted relative to the vertical support 10, and can be inserted directly through the holes 12 and moved downwardly for firm engagement. The elimination of the rotation of the assembly 22 allows the hanger assembly 22 to be mounted more closely to other display apparatus also mounted to the pegboard 10, and allows the hanger assembly 22 to be mounted directly beneath such other display apparatus. Likewise, additional locking mechanisms are unnecessary to firmly mount the bracket 20 to the vertical support 10.

It will be recognized that the close tolerancing of the prongs 60, 70 and particularly the horizontal dimension of the chamber 63, 73, allows the mounting bracket 20 to be firmly engaged to the vertical support 10 by virtue of its dimensioning. In fact, the vertical support 10 may be compressed slightly when the mounting brackets 20 are attached thereto.

Pegboard is typically made of a wood or paper-based particleboard which will vary with manufacturer. Typically however, pegboard has a thickness of about 0.230–0.235 inches or above. Accordingly the horizontal dimension of the interior chambers 63, 73 has been closely toleranced to between approximately 0.230 and 0.235 inches to closely conform to such pegboard.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A mounting bracket for mounting a display hook to a vertical support having regularly spaced apertures, the mounting bracket comprising:

a plate having a front surface constructed to attach the display hook thereto;

a first pair of laterally spaced prongs positioned adjacent a top edge of the plate, the prongs for attaching the plate to the vertical support via the apertures such that after attaching the prongs through the apertures the apertures remain substantially free of obstruction, each of the prongs having a first portion extending rearwardly and perpendicularly from the plate and a second portion extending downwardly and perpendicularly to the first portion from the first portion to a terminating end, the second portion having a vertical height less than or equal to a diameter of the apertures;

an interior chamber defined by the rear surface of the plate and at least two inner surfaces of the first and second portions of the prongs, the interior chamber having a horizontal width between the terminating ends and the rear surface of the plate less than or equal to the thickness of the vertical support such that the rear and inner surfaces firmly engage the vertical support and attach the mounting bracket thereto; and a second pair of laterally spaced prongs connected to the plate positioned vertically spaced from the first pair of prongs;

a retention portion of the plate extending below the second pair of laterally spaced prongs, the retention portion disposed between the second pair of laterally spaced prongs; and a pair of bosses disposed horizontally on the plate, the pair of bosses enabling the mounting bracket to have a display hanger attached thereto.

2. The mounting bracket of claim 1, wherein the horizontal width of the chamber is between about 0.230 to about 0.235 inches.

3. The mounting bracket of claim 1, wherein the horizontal width is less than the thickness of the vertical support.

4. The mounting bracket of claim 1, wherein the prongs compress the vertical support when attached thereto.

5. The mounting bracket of claim 1, wherein an upper portion of the plate extends above the inner surface of the first portion of the prongs to provide rotational stability.

6. The mounting bracket of claim 1, wherein the prongs are integrally formed with the plate.

7. The mounting bracket of claim 1, wherein the bracket is stamp formed from sheet metal.

8. The mounting bracket of claim 1, wherein the bracket is of a unitary one-piece construction.

9. The mounting bracket of claim 1, wherein the second pair of laterally spaced prongs extend rearwardly from the plate.

10. The mounting bracket of claim 1, wherein the second pair of laterally spaced prongs are unitarily formed with the plate.

11. The mounting bracket of claim 1 wherein only the first pair of laterally spaced prongs and the second pair of prongs enter the apertures.

12. The mounting bracket of claim 1 wherein the second pair of prongs are for attaching the plate to the vertical support via the apertures.

* * * * *